US007628285B2

(12) United States Patent
Salvia

(10) Patent No.: US 7,628,285 B2
(45) Date of Patent: Dec. 8, 2009

(54) BOTTLE WITH ANTI-SLIPPAGE PRINTS

(76) Inventor: Eduardo Salvia, Via Alberto da Giussano 15, Milan (IT) 20145

( * ) Notice: Subject to any disclaimer, the term of this patent is extended or adjusted under 35 U.S.C. 154(b) by 250 days.

(21) Appl. No.: 11/377,934

(22) Filed: Mar. 16, 2006

(65) Prior Publication Data

US 2006/0266729 A1 Nov. 30, 2006

(30) Foreign Application Priority Data

Mar. 17, 2005 (EP) ..... 00312079

(51) Int. Cl.
*B65D 23/10* (2006.01)

(52) U.S. Cl. ..... 215/384; 215/398; 220/755; 220/772

(58) Field of Classification Search ..... 215/379, 215/382–384, 398, 396, 397; 220/772, 755; D7/509–511

See application file for complete search history.

(56) References Cited

U.S. PATENT DOCUMENTS

D161,698 S * 1/1951 Lorenzen ..... D9/542
D221,133 S * 7/1971 Wikke ..... D9/529
4,273,248 A * 6/1981 Lehmann ..... 215/331
4,846,359 A 7/1989 Baird et al.
5,158,190 A * 10/1992 Sosenko ..... 215/384
5,330,054 A * 7/1994 Brown ..... 206/459.5
D370,635 S * 6/1996 Dutton ..... D9/540
D376,729 S * 12/1996 Maki ..... D7/514
5,927,533 A * 7/1999 Payne et al. ..... 215/384
D429,648 S * 8/2000 Goettner ..... D9/540
D447,697 S * 9/2001 Schultz et al. ..... D9/542
D467,809 S * 12/2002 Pouillot et al. ..... D9/523
D491,067 S 6/2004 Crawford
D492,546 S * 7/2004 Bodum ..... D7/510
D501,362 S * 2/2005 Gauss ..... D7/510
D512,875 S * 12/2005 Maldonado ..... D7/510
2005/0092708 A1* 5/2005 Heisner et al. ..... 215/384
2008/0110854 A1* 5/2008 Kelly ..... 215/384

* cited by examiner

*Primary Examiner*—Sue A Weaver
(74) *Attorney, Agent, or Firm*—Fredrikson & Byron, P.A.

(57) ABSTRACT

The invention relates to a bottle that allows an improved grip to prevent slippage from the hands of a person. To reach this object, prints are provided on opposite sides of the body (2) of the bottle having a substantially elliptical shape and extended in a transversal direction with respect to the bottle; in particular, the body of the bottle has a prismatic shape and the prints are formed on respective opposite faces (5, 6).

8 Claims, 2 Drawing Sheets

BOTTLE WITH ANTI-SLIPPAGE PRINTS

FIELD

The invention relates to a bottle that allows an improved grip to prevent slippage from the hands of a person.

BACKGROUND

As is known, bottles containing oily or soapy liquids are inevitably slippery after a time; therefore they can be difficult to grasp and thus they are often formed with particular shapes that make handgrip more secure.

For example, bottles provided with handles or shaped with indented sides are known, that allow an efficient grasp; reference is made to bottles shown in U.S. Pat. Nos. 4,846,359 and D491,067. Nevertheless these shape features have a strong impact on the appearance of the body of the bottle; this impact sometimes is not acceptable.

For example it can be understood that bottles provided with handgrip work in a good way for soap, detersives and the like, but they do not fit with products which are more valuable and expensive such as olive oil, for which the aesthetic aspect of the packaging is important.

Also for this reason detersives are usually contained in plastic bottles that can be produced at a low cost and in a relatively easy way (for moulding and the like) with different shapes, while olive oil is mostly sold in glass bottles which are more expensive and difficult to manufacture, particularly in the case of complex shapes as those with handgrips and the like.

SUMMARY

In view of this state of the art, the object of the present invention is to provide a bottle that can be grasped in a more secure way with one hand, even not being provided with handles, handgrips, protrusions and similar elements that modify, excessively, the aesthetic appearance of the bottle.

This object is achieved by a bottle that has a first print on one side and at least a second print on the opposite side, both prints having a substantially elliptical shape for reproducing the contact area of the fingertip of the fingers of a hand.

DETAILED DESCRIPTION

Figure 2:
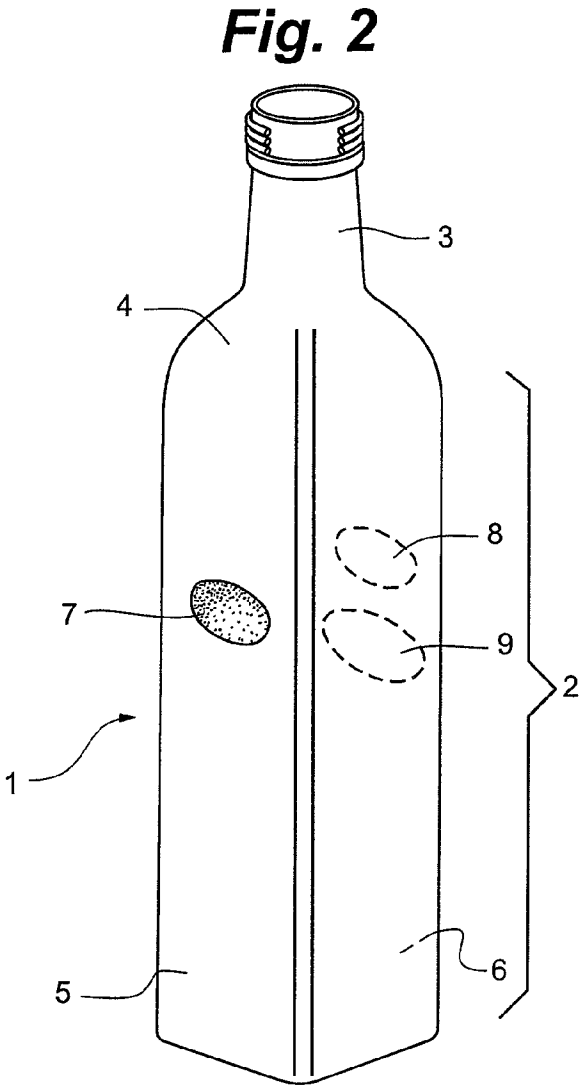
FIG. 2 is a perspective elevational view of the bottle of FIG. 1 including another set of prints in accordance with certain embodiments the invention.
Figure 1:
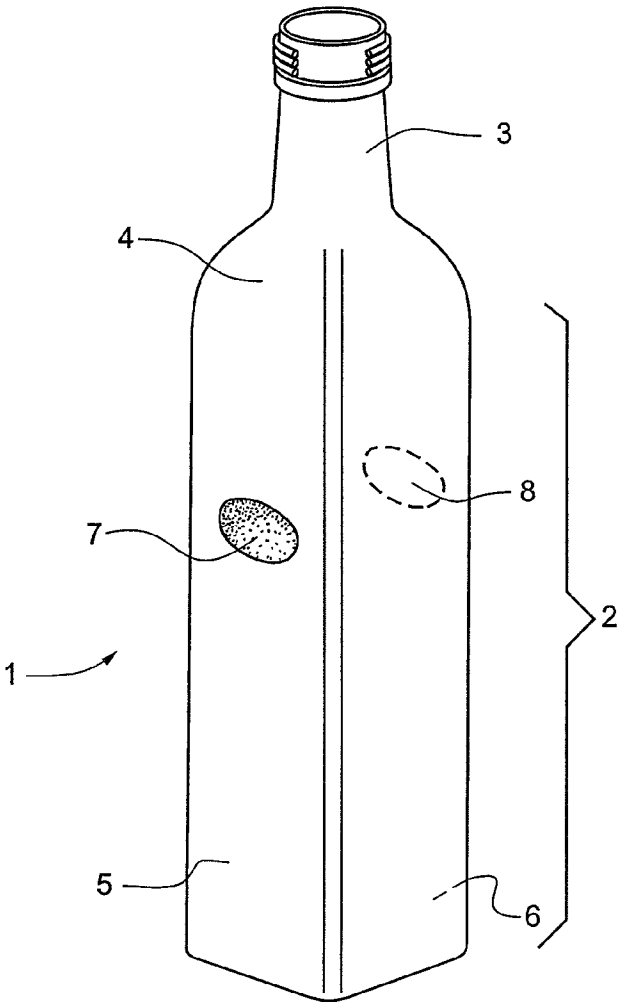
FIG. 1 is a perspective elevational view of a bottle including a set of prints in accordance with certain embodiments of the invention.

According to a preferred embodiment the body of the bottle, i.e., the part under the neck, has a prismatic shape and the prints are formed on respectively opposite sides thereof; furthermore, the body of the bottle is preferably prismatic with a square base.

Other features and advantages of the invention will be more evident from the description below of some embodiments shown in the accompanying drawings, wherein the FIGS. 1, 2, 3, and 4 are respective perspective views of bottles according to the invention.

With reference to the first of these figures, there is shown a glass bottle as a whole generally indicated with 1, intended particularly for valuable products such as olive oil. As it can be seen the body of the bottle 2 has a prismatic shape with a square base, joined to a neck 3 in correspondence of the shoulders 4 of the bottle.

On two opposite sides 5 and 6 of the body 2 there are respective prints 7 and 8 elliptically shaped, the same as each other; as it can be easily understood, these prints serve to improve the gripping of the bottle with one hand, placing the fingertip of the thumb in one of them and the fingertip of the index finger in the other. As shown, the sides of the body 2 are substantially planar.

The effect of improving the grip can be further increased adding a print 9 under one of the previous prints, which in the case shown in FIG. 2 is the print indicated as 8.

According to a second preferred embodiment, this additional print has an elliptical shape with larger dimensions with respect to the other, thereby making it more ergonomic. According to FIGS. 3 and 4, other additional prints 10 and 11 can be added on the same side of the bottle, for the remaining fingers of the hand; these additional prints have the same elliptical shape of the previous, but have dimensions respectively decreasing to adapt them better to the fingertip of the ring finger and the little finger.

In view of the foregoing it can be understood how the bottles above achieve the object of the invention.

Indeed the presence of a first print on a side of the prismatic body of the bottle and of at least a second print on the opposite side, allows the gripping of the bottle in a secure way with the fingertips of the thumb and of the index finger (or of the middle finger), without needing handles, handgrips, or other similar elements that modify, excessively, the appearance of the bottle.

Figure 4:
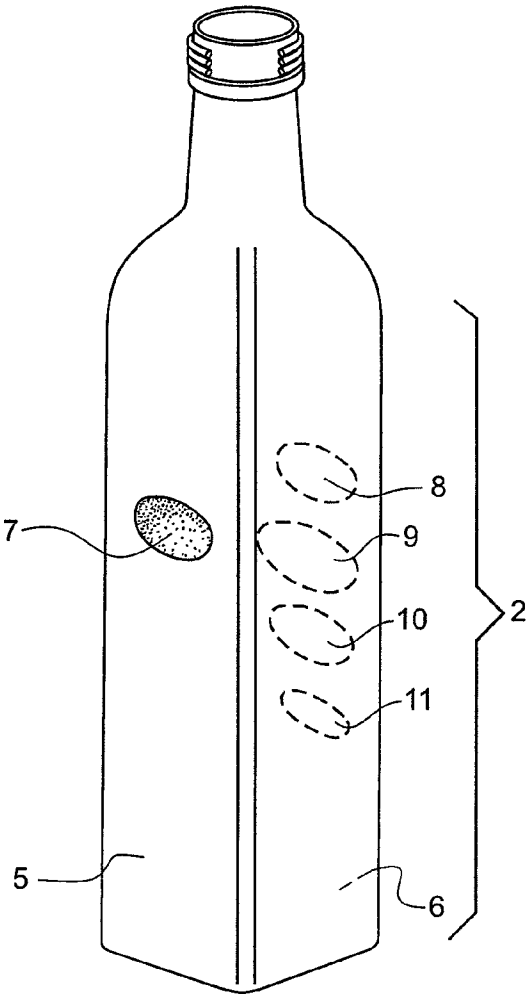
FIG. 4 is a perspective elevational view of the bottle of FIG. 1 including an additional set of prints in accordance with certain embodiments of the invention.
Figure 3:
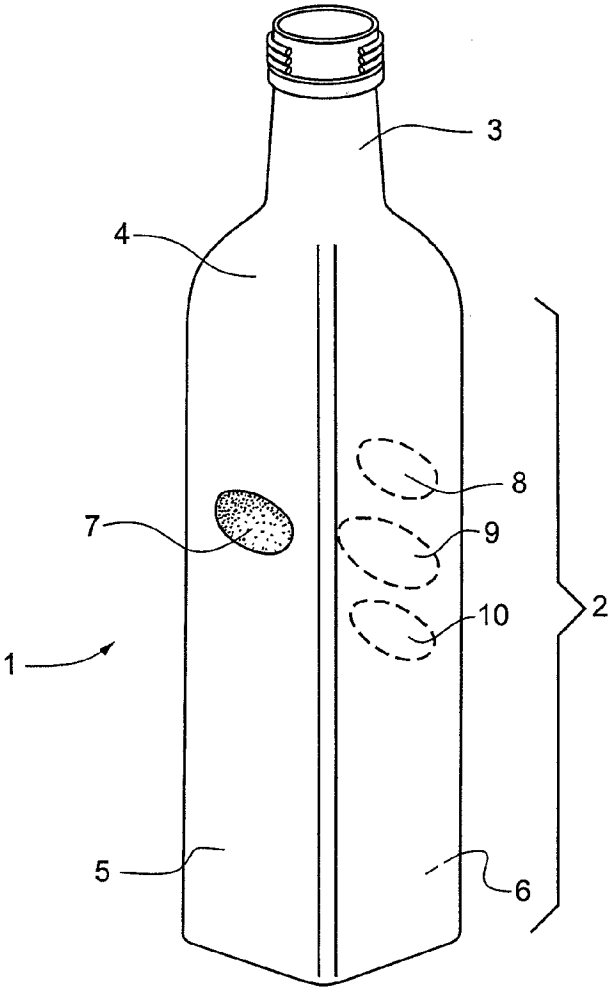
FIG. 3 is a perspective elevational view of the bottle of FIG. 1 including a further set of prints in accordance with certain embodiments of the invention.

The elliptical shape of the prints and their different dimensions, as in FIGS. 2-4, further improve the grip; all of these variants fall within the scope of the following claims.

The invention claimed is:

1. Bottle comprising a body joined upward to a neck, characterized in that the body comprises a plurality of prints dimensioned to match fingertips, the plurality of prints comprising a first print and a second print on opposite sides of the body, the first and second prints each having a substantially elliptical shape extended in a direction transversal to the body, the body being made of glass.

2. Bottle according to claim 1, wherein the body has a prismatic shape and the first and second prints are formed on respective opposite faces of the body.

3. Bottle according to claim 2, wherein the plurality of prints further comprises a third print beneath the second print, the third print having substantially similar shape yet larger dimensions than the second print.

4. Bottle according to claim 3, wherein the plurality of prints further comprises a fourth print beneath the third print, the fourth print having substantially similar shape yet smaller dimensions than the third print.

5. Bottle according to claim 4, wherein the plurality of prints further comprises a fifth print beneath the fourth print, the fifth print having substantially similar shape yet smaller dimensions than the fourth print.

6. Bottle according to any of the preceding claims, wherein the body has a squared base.

7. Bottle according to claim 1, wherein each of the sides of the body are substantially planar.

8. Bottle according to claim 1, wherein the bottle is configured to contain an oily or soapy liquid.

* * * * *

UNITED STATES PATENT AND TRADEMARK OFFICE

CERTIFICATE OF CORRECTION

PATENT NO. : 7,628,285 B2
APPLICATION NO. : 11/377934
DATED : December 8, 2009
INVENTOR(S) : Eduardo Salvia It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 515 days.

Signed and Sealed this

Twenty-first Day of December, 2010

David J. Kappos

David J. Kappos
*Director of the United States Patent and Trademark Office*